United States Patent [19]

Sayles

[11] Patent Number: 5,050,683

[45] Date of Patent: Sep. 24, 1991

[54] EXTINGUISHING ROCKET/MISSILE SOLID PROPELLANTS

[75] Inventor: David C. Sayles, Huntsville, Ala.

[73] Assignee: The United States of America as represented by the Secretary of the Army, Washington, D.C.

[21] Appl. No.: 522,707

[22] Filed: May 14, 1990

[51] Int. Cl.[5] ..... A62C 3/00; A62C 13/62

[52] U.S. Cl. ..... 169/46; 169/47; 169/35

[58] Field of Search ..... 169/26, 28, 46, 47, 169/35, 36

[56] References Cited

U.S. PATENT DOCUMENTS

| | | | |
|---|---|---|---|
| 370,874 | 10/1887 | Johnson | 169/28 |
| 551,600 | 12/1895 | Oliver | 169/28 |
| 1,933,694 | 4/1930 | Allen et al. | 169/26 |
| 2,450,569 | 10/1948 | Thompson | 169/28 |
| 2,665,768 | 1/1954 | Talbot | 169/36 |
| 3,833,063 | 9/1974 | Williams | 169/36 |
| 4,637,472 | 1/1987 | Decima | 169/28 |
| 4,760,886 | 8/1988 | Sassier | 169/28 |
| 4,964,469 | 10/1990 | Smith | 169/28 |

OTHER PUBLICATIONS

Finnerty et al., Fast Dispensing Fire Extinguisher, U.S. Statutory Invention Registration 10/7/86.

*Primary Examiner*—Joseph F. Peters, Jr.
*Assistant Examiner*—Virna Lissi Mojica
*Attorney, Agent, or Firm*—Freddie M. Bush

[57] ABSTRACT

A method of extinguishing burning rocket or missile solid propellant employs a device including an explosive charge which is submerged in an extinguishant agent contained in container positioned near the rocket or missile solid propellant being tested or stored. An electrically initiated detonator or heat initiated detonator initiates the explosive charge which causes the extinguishant agent to be explosively driven or propelled horizontally, almost in a solid mass, to the sites of burning propellant to achieve extinguishment within milliseconds. The composition of a preferred extinguishant agent is ethylene glycol of about 55 weight percent, water of about 25 weight percent, and foaming agent of about 20 weight percent.

4 Claims, 1 Drawing Sheet

EXTINGUISHING ROCKET/MISSILE SOLID PROPELLANTS

DEDICATORY CLAUSE

The invention described herein may be manufactured, used, and licensed by or for the Government for governmental purposes without the payment to me of any royalties thereon.

BACKGROUND OF THE INVENTION

Extinguishing hydrocarbon fires is achieved by gas phase interruption of the free radical chain reaction in the oxidation process. The conventional methods of extinguishing hydrocarbon fires involve the use of extinguishing agents, such as, the Halon 1301-type and water-based foams. Halon designates extinguishant of polyhalogenated hydrocarbons containing fluorine, chlorine, and bromine. Another extinguishant of the described type is Halon 1211 which is bromochlorodifluoromethane. Extinguishing burning solid propellants, since solid propellants contains their self contained fuels and oxidizers, places these materials in a different category from the usual hydrocarbon air fires.

Because of the extremely, rapid burning rate of solid propellants, a means to bring an effective extinguishant to the burning sites of propellant fires in a fraction of a second to extinguish the propellant fire is a minimum requirement for effectiveness. Meeting this requirement is recognized as a major advancement which would yield an important contribution to this area of fire control.

Solid propellant burns at a higher rate when it is confined than when it is in an open area or when unconfined; however, when solid propellant is burning in an open area and when the pressure drops below a minimum value to sustain flame burning, such as by smoldering, may still take place. Thus, a special technique would be required to extinguish even the smoldering solid propellant since solid propellant has both the fuel and oxidizer needed to sustain combustion without an outside source of oxidizer or fuel.

SUMMARY OF THE INVENTION

A means to bring an effective extinguishant to the burning sites of solid propellant fires within milliseconds (or within essentially an instantaneous interval) achieves the objective of this invention in accordance with the provisions of this invention to follow.

An explosive charge is used as the means, in accordance with the invention method, for projecting an extinguishing liquid to the sites of burning propellant to achieve extinguishment thereof within milliseconds.

An extinguishant agent is propelled horizontally, almost in a solid mass, without much of the extinguishant agent being dispersed in other directions from a test setup described below and illustrated in the drawing.

A plastic container (of about four liters capacity) is filled with a liquid extinguishant agent. A 25-cm length of Primacord (containing 22 grams of explosive) is submerged in the liquid extinguishant agent, and a detonator is attached to the end of the Primacord which protrudes out of the extinguishant agent. A framing camera (operating at a speed of 500 frames per second) is used to record what occurs when the detonator is functioned. The film reveals that the extinguishant agent is projected at the rate of approximately one meter in 6 milliseconds (msec) in the manner described above. The major difference between this explosive dispersing system and the usual pressurized extinguisher is that it delivers the leading edge of the stream of the extinguishing liquid to the burning site within milliseconds.

DESCRIPTION OF THE PREFERRED EMBODIMENT(S)

Figure 1:
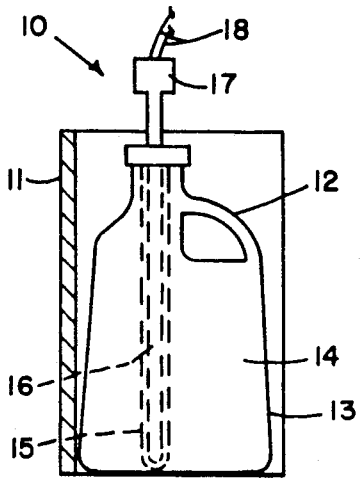
FIG. 1 depicts a device for high-speed projection of fire extinguishant agent.

The mechanism for extinguishing a burning solid propellant by propelling an extinguish agent by an explosive force is depicted in FIG. 1 of the drawing.

In further reference to the drawing, FIG. 1 depicts a device 10 for high-speed projection of fire extinguishant agent. The device 10 comprises a plastic container 12 in the shape of a plastic jug having walls 13 for containing fire extinguishant agent 14 (not shown). A steel deflector plate 11 is shown which serves to directionally focus the extinguishant agent perpendicular to the steel plate. Up to three steel plates can be employed to provide further directional focusing of the extinguishant agent. An extinguishant agent resistant tube 15 is shown extending the entire length of container 12. A detonating cord 16 is shown inside tube 15 with a detonator 17 having electrical leads 18 connected thereto for initiating detonating cord 16 when connected to a power source (not shown). The detonator can also be of the heat initiated type as further noted below.

Figure 2:
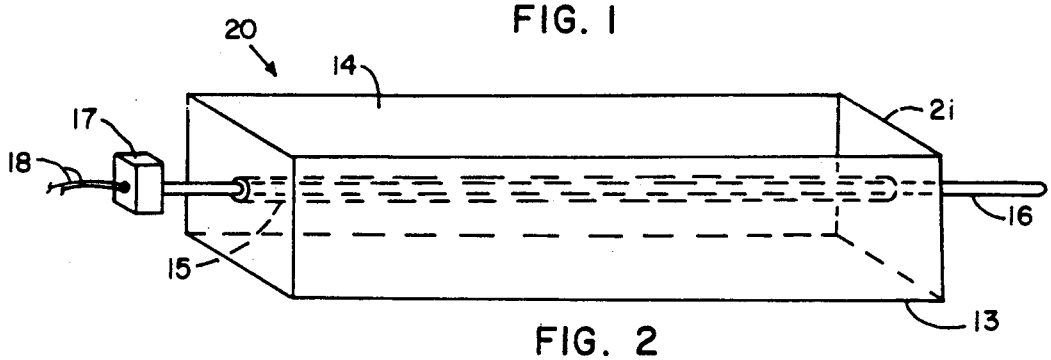
FIG. 2 depicts another embodiment of a device for high-speed projecting of fire extinguishant agent.

FIG. 2 depicts another embodiment of a device 20 for high-speed projection of fire extinguishant agent. This device having like numeral designations for similar parts as shown for FIG. 1 is in the form of a rectangular container 21 and functions in a similar manner to the device of FIG. 1. A rectangular metal container, a three sided steel box without cover, was employed to test the efficiency of extinguishing burning solid propellant which has an advance start in burning as further described hereinbelow.

EXAMPLE I

The success of the instant invention is the use of an explosive charge as the means of projecting the extinguishing liquid or agent to the sites of burning propellant instantaneously.

Figure 3:
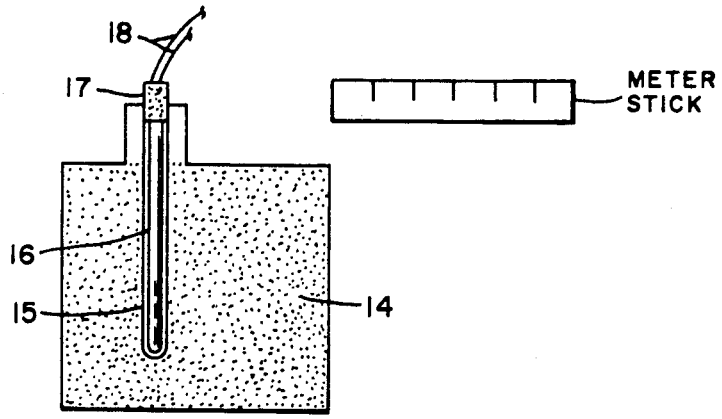
FIG. 3 depicts a schematic test setup wherein the horizontal projection of the extinguishant agent is to be illustrated, as recorded by high speed framing camera.
Figure 4:
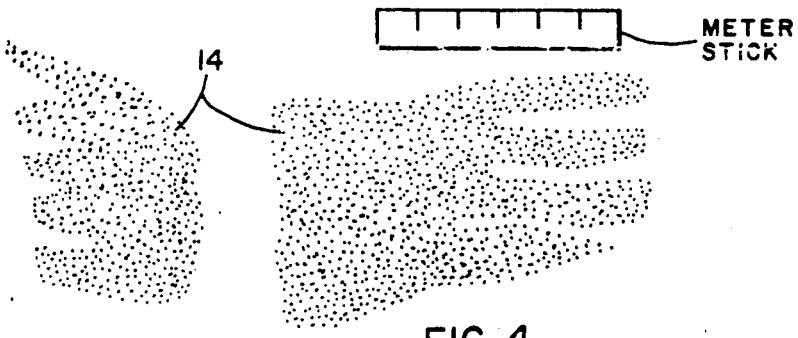
FIG. 4 depicts horizontal projection of the extinguishant agent as recorded by high speed framing camera.

This concept and device for extinguishing a burning solid propellant, is depicted in FIG. 1. The effectiveness of this concept is demonstrated by the following test setup: A plastic container (of about four liters capacity) is filled with the extinguishing solution. A 25-cm length of Primacord (containing 22 g explosive) is submerged in the extinguishing liquid, and a detonator is attached to the end of the Primacord which protruded out of the extinguishing liquid. A framing camera (operating at a speed of 500 frames per second) is used to record what occurred when the detonator functioned. From the film, it was determined that the extinguishing liquid was projected at the rate of approximately one meter in 6 milliseconds (msec). It was observed that in this test setup the extinguishing liquid is propelled horizontally almost in a solid mass without much liquid dispersed in other directions. A schematic of the test setup is depicted in FIG. 3. FIG. 4 depicts horizontal projection of the extinguishant agent as recorded.

The major difference between this explosive dispersing system and the usual pressurized extinguisher is that it delivers the leading edge of the stream of the extinguishant liquid to the burning site within milliseconds. The explosively-driven extinguishant, also, lends itself to: (a) being directionally focussed by the suitable placement of the explosive charge within the liquid, (b) by the shape of the container of the extinguishing liquid, and (c) by the backing on the backside of the container by the means of a steel plate.

Experience has shown that when using the conventional pressurized extinguishers, the propellant fire had to be hit with the extinguishing agent as quickly as possible. In order to prove that the explosively-driven extinguishant is markedly superior, an experiment is carried out in which there is a considerable time lapse before quenching of the propellant is undertaken. In this test, the propellant is allowed to grow to its near-maximum intensity before the explosively-driven extinguishant is launched at it.

In order to determine how much more effective the suppression of the burning by the explosive extinguisher is over the conventional extinguisher, a propellant fire is permitted to burn until it achieved maximum intensity before the explosive extinguisher is activated.

EXAMPLE II

The test setup used to demonstrate the ease of extinguishing a burning propellant, which is burning at maximum intensity, is described under (a-h) as follows: (a) A three-sided steel box without cover (1−1 m, h=1 m, w=1.5 m) is used to contain both the explosive charge and the extinguishing liquid. (b) A propellant charge of 23 Kg (50 lbs) is used and is located in close proximity to the three-sided steel box (c) The extinguishant agent consisted of approximately 34 liters (9 gallons) of a 20% foaming agent in ethylene glycol-water mixture. The Primacord charge (i.e. explosive charge) contained 7.8 grams of explosive. (d) The extinguisher is functioned 8 seconds after the propellant is ignited. (e) The flames reached a height of 6 meters before the extinguisher is functioned. (f) Heat from the burning propellant is used as the means of initiating the explosive contained in the detonator. This heat detonated the 7.8 grams of explosive contained in the Primacord. (g) The propellant fire is quenched almost immediately (within a few milliseconds). (h) The amount of propellant remaining after the quench was 11 kg (24 lbs).

The conclusion from this test is that explosive-activated extinguishers can quench a propellant fire in a fraction of the time that this can be accomplished by a conventional extinguisher which delivers its extinguishant over a long period of time.

In further reference to the Drawing FIG. 3, and particularly to FIG. 4, and the test setup described under Example I, the extinguishant agent 14 is depicted in a horizontal projected mode after being propelled by a linear explosive 16 depicted in FIG. 3. The meter stick depicts the distance that the extinguishant agent is propelled in a time interval of about 6 milliseconds (msec). The distance and time interval is interpreted from test data obtained from a framing camera operating at a speed of 500 frames per second. The horizontally propelled extinguishant agent 14 is observed to be propelled almost in a solid mass without much of the extinguishant agent being dispersed in other directions. This horizontally propelled solid mass is a result of explosive charge placement in the extinguishant agent and the use of a deflector steel plate on the backside which serves to focus the explosive force in the desired direction. Thus, an effective distance of the device from solid propellant desired to be extinguished is about one meter where the extinguishant agent reaches the burning sites of the solid propellant in about 6 milliseconds. The slower the propellant burning rate the more time would be available for extinguishment.

The following Table discloses the composition of the extinguishant agent or extinguishing liquid employed in this invention.

TABLE I

| COMPOSITION OF EXTINGUISHING LIQUID | |
|---|---|
| Ethylene glycol | 55% weight percent |
| Water | 25% weight percent |
| Foaming agent* | 20% weight percent |

*The type commonly employed is fire fighting activities.

The composition of the extinguishant agent of Table I enables it to be functional over a wide temperature range since the ethylene glycol water mixture is an anti-freeze mixture. The additional desirable feature of the ethylene glycol water mixture is related to the tendency of a heavy alcohol-water combination to not bounce back from the surface with which it impacts. The combination has an enhanced ability to wet the surface and cool the surface, particularly in combination with a foaming agent.

Example of a natural composition which can be used as foaming agent is licorice. Glycerol is another composition which also can function in this capacity.

The containers for containing the extinguishant agent for use in accordance with this invention should have sufficient strength to contain the extinguishant agent, should be one that is not reactive with the extinguishant agent, and should yield instantaneously to an explosive force used to propel the extinguishant agent. Plastic is suitable in most cases for use. As disclosed hereinabove, a three-sided steel box without a cover has application where the explosive forces are to be directed through the area normally occupied by the cover. The area of uses for this invention should be where solid propellants are stored or where test areas result in solid propellant grain burning that is desired to be extinguished due to burning abnormalities as a result of case rupturing or other malfunctions.

I claim:

1. A method for extinguishing rocket or missile solid propellant including the employment of a device in combination with said method to explosively drive, in substantially an instantaneous time interval, a large amount of extinguishant agent to the burning sites of propellant, said device comprising a container for containing a liquid extinguishant agent, and an explosive charge having detonator means to initiate said explosive charge for said method which comprises:

(i) providing a container of a predetermined capacity for containing a containing a liquid extinguishant agent, said container being a container which is non-reactive with said liquid extinguishant agent and said container having a structure of a three-sides rectangular steel box without cover and wherein said explosive charge explosively drives said extinguishant agent through the area normally occupied by said cover, and wherein said extinguishant agent is comprises of about 55 weight percent ethylene glycol, of about 25 weight percent water, and of 20 weight percent foaming agent;

(ii) adding said liquid extinguishant agent to substantially fill said container;

(iii) submerging a predetermined length of a detonator cord into said liquid extinguishant agent, said detonator cord containing a predetermined amount of an explosive charge per length of said detonator cord and said detonator cord having a portion of said detonating cord protruding out of said liquid extinguishant agent;

(iv) equipping said portion of said detonator cord protruding out of said liquid extinguishant agent with a detonator having means to detonate said detonator which subsequently initiates said explosive charge contained in said detonator cord; and, (v) positioning said device an effective distance form a rocket or missile solid propellant being tested or stored and which may result in abnormal burning of said solid propellant to take place and whereby said device when functioned provides the capability of explosively driving an extinguishant agent instantaneously to sites of burning solid propellant; and, (vi) detonating said detonator which initiates said explosive charge explosively drive said extinguishant agent to the burning sites of solid propellant to achieve extinguishing of said rocket or missile solid propellant.

2. The method for extinguishing rocket or missile solid propellant as defined in claim 1 wherein said detonator means to detonate is responsive to an electrically initiated source.

3. The method for extinguishing rocket or missile solid propellant as defined in claim 1 wherein said detonator means to detonate is responsive to a heat initiated source.

4. The method for extinguishing rocket or missile solid propellant as defined in claim 3 wherein said detonator cord contains about 7.8 grams of explosive and wherein said extinguishant agent is explosively driven when said detonator is functioned by heat at about 8 seconds after a solid propellant charge of 50 pounds is ignited and, after flame from said solid propellant charge reaches a height of about 6 meters, said flame of said solid propellant is quenched within a few milliseconds after said detonator is functioned, and wherein the amount of solid propellant remaining after flame quench is 24 pounds.

* * * * *